US010429785B2

(12) United States Patent
Mukoyama et al.

(10) Patent No.: US 10,429,785 B2
(45) Date of Patent: Oct. 1, 2019

(54) FIXING BELT HAVING HIGH SEPARABILITY, FIXING DEVICE, AND IMAGE FORMING APPARATUS

(71) Applicant: Konica Minolta, Inc., Tokyo (JP)

(72) Inventors: Izumi Mukoyama, Tokyo (JP); Naoko Uemura, Tokyo (JP); Akiko Kawamura, Tokyo (JP); Asao Matsushima, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/249,002

(22) Filed: Jan. 16, 2019

(65) Prior Publication Data

US 2019/0235427 A1 Aug. 1, 2019

(51) Int. Cl.
*G03G 15/20* (2006.01)

(52) U.S. Cl.
CPC ..... *G03G 15/2057* (2013.01)

(58) Field of Classification Search
CPC ..... G03G 15/2053; G03G 15/2057
USPC ..... 399/333
See application file for complete search history.

(56) References Cited

U.S. PATENT DOCUMENTS 6,785,506 B2 * 8/2004 Kato et al. ..... G03G 15/2053 399/333
8,676,106 B2 * 3/2014 Hara ..... G03G 15/2053 399/333
9,354,571 B2 * 5/2016 Miura et al. ..... G03G 15/2057

FOREIGN PATENT DOCUMENTS

JP 2012108545 A 6/2012

* cited by examiner

*Primary Examiner* — William J Royer
(74) *Attorney, Agent, or Firm* — Lucas & Mercanti, LLP

(57) ABSTRACT

A fixing belt having high separability is provided. The fixing belt includes a base layer made of a heat-resistant resin, an intermediate layer made of a heat-resistant elastic material disposed on the base layer, and a surface layer made of a fluororesin disposed on the intermediate layer. The surface layer contains 5 to 15 mass % of carbon black having a primary average particle diameter of 10 to 50 μm.

8 Claims, 3 Drawing Sheets

FIXING BELT HAVING HIGH SEPARABILITY, FIXING DEVICE, AND IMAGE FORMING APPARATUS

CROSS REFERENCE TO RELATED APPLICATIONS

The entire disclosure of Japanese Patent Application No. 2018-015073 filed on Jan. 31, 2018, is incorporated herein by reference in its entirety.

BACKGROUND

Technological Field

The present invention relates to a fixing belt, a fixing device, and an image forming apparatus.

Description of Related Art

Conventionally, an electrophotographic image forming apparatus including a copier, a laser beam printer, and the like adopts a fixing device in which a heated fixing belt is brought into contact with a toner receiving article bearing an unfixed toner image and the toner image is fixed on the toner receiving article. As such a fixing device, there is known a fixing device having a fixing belt and two or more rollers that include a heating roller and pivotally support the fixing belt (see, for example, Japanese Patent Application Laid-Open No. 2012-108545).

In the fixing device described in Japanese Patent Application Laid-Open No. 2012-108545, a curvature at an exit of a nip formed by the fixing belt on an upper pressure member (roller) and a lower pressure member (roller) is increased, and releasability of a recording medium from a surface of the fixing belt is improved. Accordingly, separability between the fixing belt and the recording medium is improved.

However, in order to increase printing speed in the image forming apparatus, it is necessary to increase heat capacity by enlarging the upper pressure member and the lower pressure member to compensate for heat loss due to continuous printing. When the upper pressure member and the lower pressure member are enlarged, a curvature on an exit side is reduced. Further, since a proportion of impurities in a fluororesin material that promotes a releasing effect used for a surface layer of the fixing belt is very small, it is considered that improvement of the releasability by further reducing the impurities is difficult.

When the fluororesin is used as a material of the surface layer as in Japanese Patent Application Laid-Open No. 2012-108545, non-stickiness of the surface layer is determined by the number of fluoro groups disposed on a surface of the surface layer. However, as described above, since impurities other than the fluoro groups are hardly contained in the fluororesin, it is considered that improvement of the non-stickiness by reforming the fluororesin is difficult.

SUMMARY

An object of the present invention is to provide a fixing belt having high separability, a fixing device including the fixing belt, and an image forming apparatus.

To achieve at least one of the abovementioned objects, according to an aspect of the present invention, a fixing belt reflecting one aspect of the present invention comprises: a base layer made of a heat-resistant resin; an intermediate layer made of a heat-resistant elastic material disposed on the base layer; and a surface layer made of a fluororesin disposed on the intermediate layer, the surface layer containing 5 to 15 mass % of carbon black having a primary average particle diameter of 10 to 50 μm.

To achieve at least one of the abovementioned objects, according to an aspect of the present invention, a fixing device reflecting one aspect of the present invention comprises: an endless fixing belt; two or more rollers that pivotally support the fixing belt; a heater that heats the fixing belt; and a pressure roller disposed so as to be urged relatively with respect to one of the two or more rollers via the fixing belt, wherein an outer diameter of the one of the two or more rollers that is urged by the pressure roller is 50 mm or more, and the fixing belt is the fixing belt according to the present invention.

To achieve at least one of the abovementioned objects, according to an aspect of the present invention, an image forming apparatus reflecting one aspect of the present invention comprises: a fixing device that fixes an unfixed toner image electrophotographically formed on a recording medium onto the recording medium by heating and pressing, wherein the fixing device is the fixing device according to the present invention.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Hereinafter, an embodiment of the present invention will be described in detail with reference to the accompanying drawings.

(Configurations of Image Forming Apparatus and Fixing Device)

Figure 1:
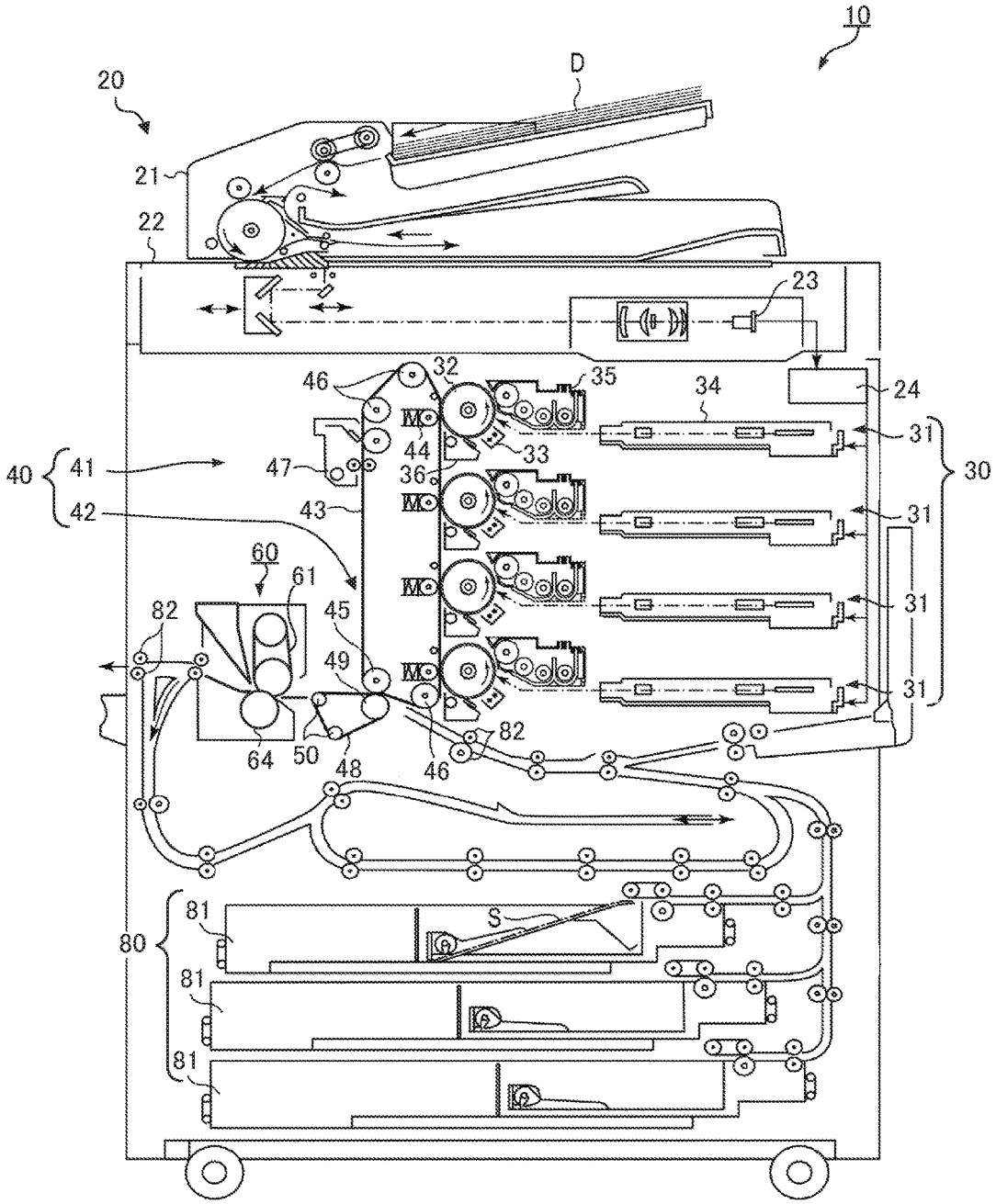
FIG. 1 is a view showing a configuration of an image forming apparatus according to an embodiment of the present invention.
Figure 2:
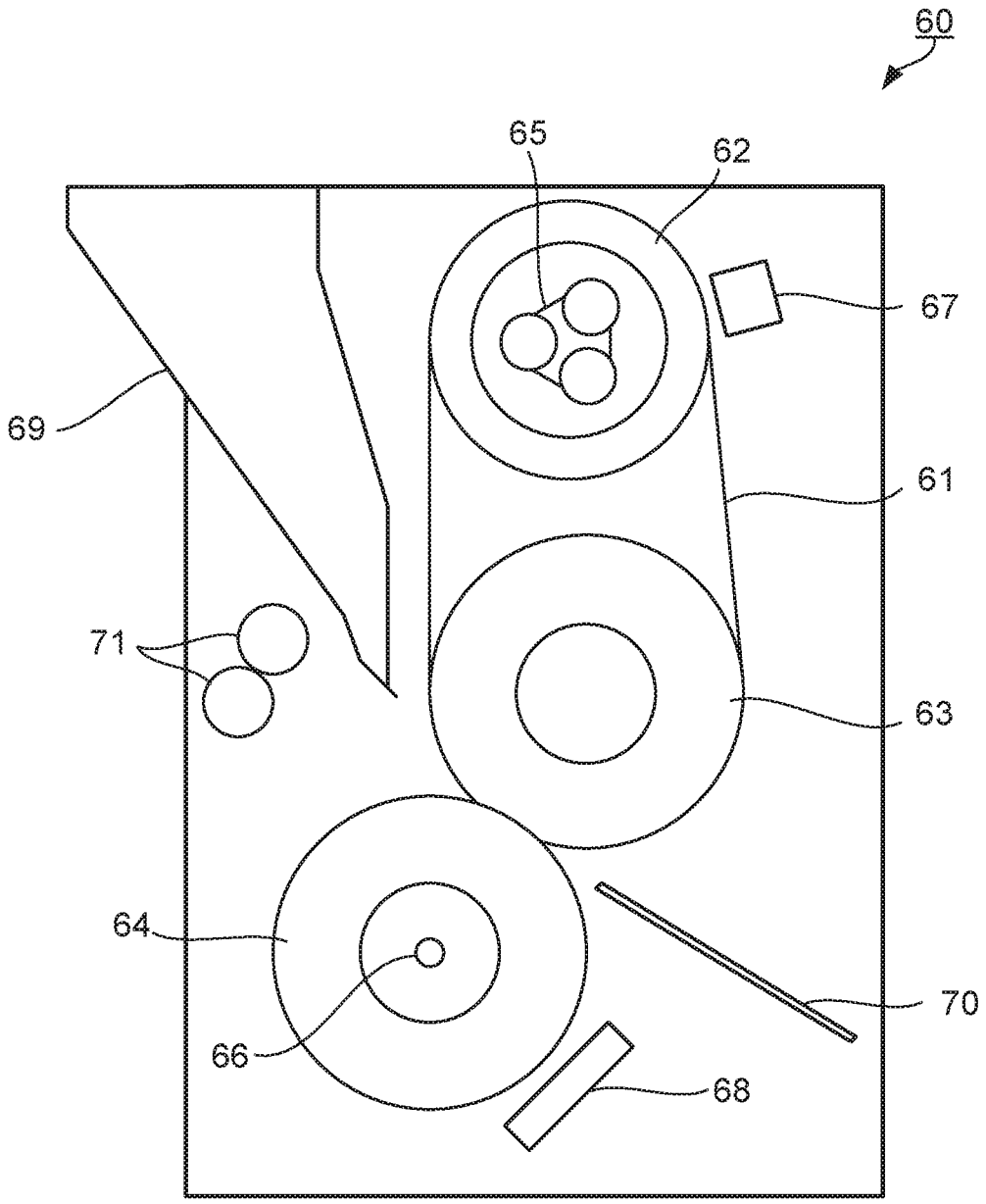
FIG. 2 is a view showing a configuration of a fixing device according to the embodiment of the present invention.

FIG. 1 is a view showing a configuration of image forming apparatus 10. FIG. 2 is a view showing a configuration of fixing device 60.

As shown in FIG. 1, image forming apparatus 10 includes image reading section 20, image forming section 30, intermediate transfer section 40, fixing device 60, and recording medium conveyance section 80.

Image reading section 20 reads an image from original D and obtains image data for forming an electrostatic latent image. Image reading section 20 includes sheet feeding device 21, scanner 22, CCD sensor 23, and image processing section 24.

Image forming section 30 includes four image forming units 31 corresponding to colors of yellow, magenta, cyan, and black, for example Image forming unit 31 includes photoconductor drum 32, charging device 33, exposing device 34, developing device 35, and cleaning device 36.

Photoconductor drum 32 is, for example, a negative charge type organic photoconductor having photoconductivity. Charging device 33 charges photoconductor drum 32. Charging device 33 is, for example, a corona charger. Charging device 33 may be a contact charging device for charging a contact charging member, such as a charging roller, a charging brush, or a charging blade, in contact with photoconductor drum 32. Exposing device 34 irradiates charged photoconductor drum 32 with light to form an electrostatic latent image. Exposing device 34 is, for example, a semiconductor laser. Developing device 35 supplies toner to photoconductor drum 32 on which the electrostatic latent image is formed, and forms a toner image corresponding to the electrostatic latent image. Developing device 35 is, for example, a known developing device in an electrophotographic image forming apparatus. Cleaning device 36 removes remaining toner on photoconductor drum 32. Here, the "toner image" refers to a state in which toner is aggregated in an image form.

As the toner, known toner can be used. The toner may be a one-component developer or a two-component developer. The one-component developer is composed of toner particles. In addition, the two-component developer is composed of toner particles and carrier particles. The toner particles are composed of toner base particles and external additives such as silica attached to a surface thereof. The toner base particles are composed of, for example, a binder resin, colorant, and wax.

Intermediate transfer section 40 includes primary transfer unit 41 and secondary transfer unit 42.

Primary transfer unit 41 includes intermediate transfer belt 43, primary transfer roller 44, backup roller 45, a plurality of first support rollers 46, and cleaning device 47. Intermediate transfer belt 43 is an endless belt. Intermediate transfer belt 43 is stretched by backup roller 45 and first support rollers 46. Intermediate transfer belt 43 runs at a constant speed in one direction on an endless track by rotationally driving at least one roller of backup roller 45 and first support rollers 46.

Secondary transfer unit 42 includes secondary transfer belt 48, secondary transfer roller 49, and a plurality of second support rollers 50. Secondary transfer belt 48 is an endless belt. Secondary transfer belt 48 is stretched by secondary transfer roller 49 and second support rollers 50.

As shown in FIG. 2, fixing device 60 includes fixing belt 61, rollers (heating roller 62 and first pressure roller 63), second pressure roller (pressure roller) 64, heaters (heating devices) 65, 66, first temperature sensor 67, second temperature sensor 68, airflow separation device 69, guide plate 70, and guide rollers 71.

Figure 3A:
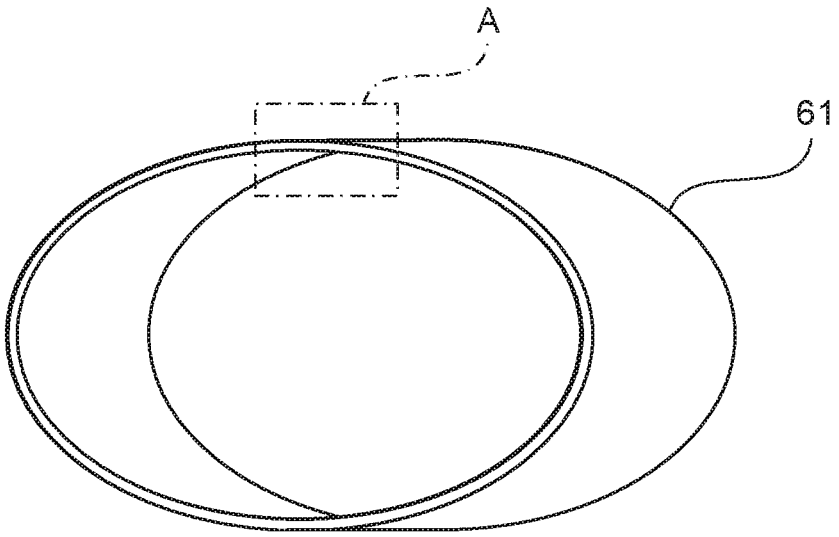
FIGS. 3A and 3B are views showing a configuration of a fixing belt according to the embodiment of the present invention.
Figure 3B:
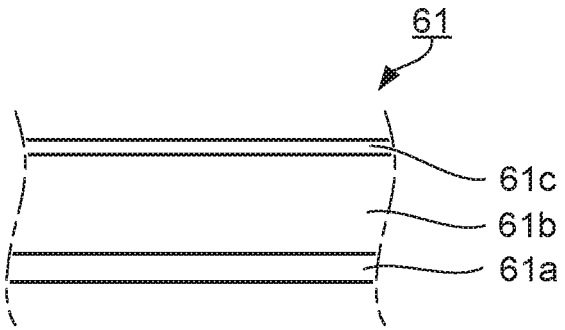

In fixing belt 61, base layer 61*a*, elastic layer 61*b*, and surface layer 61*c* are laminated in this order (see FIG. 3B). Fixing belt 61 is pivotally supported by two or more rollers with base layer 61*a* on the inside and surface layer 61*c* on the outside. In the present embodiment, fixing belt 61 is pivotally supported by heating roller 62 and first pressure roller 63. Tension of fixing belt 61 is preferably 45 N or less. If the tension of fixing belt 61 exceeds 45 N, first pressure roller 63 may be damaged. The tension of fixing belt 61 is 43 N, for example. Since one feature of the present embodiment is fixing belt 61, a detailed description of fixing belt 61 will be given later.

Heating roller 62 has a rotatable aluminum sleeve and heater 65 disposed inside the sleeve. First pressure roller 63 has, for example, a rotatable core metal and an elastic layer disposed on an outer peripheral surface thereof.

Second pressure roller 64 is disposed to face first pressure roller 63 via fixing belt 61. Second pressure roller 64 has, for example, a rotatable aluminum sleeve and heater 66 disposed in the sleeve. Second pressure roller 64 is disposed so as to be able to approach and separate from first pressure roller 63. When approaching first pressure roller 63, second pressure roller 64 presses the elastic layer of first pressure roller 63 via fixing belt 61 to form a fixing nip which is a contact with fixing belt 61. An outer diameter of first pressure roller 63 is preferably 50 mm or more. When the outer diameter of first pressure roller 63 is less than 50 mm, heat capacity of the roller cannot be secured, and printing speed of image forming apparatus 10 cannot be increased.

First temperature sensor 67 is a device for detecting temperature of fixing belt 61 heated by heating roller 62. Second temperature sensor 68 is a device for detecting temperature of an outer peripheral surface of second pressure roller 64.

Airflow separation device 69 is a device for generating airflow from a downstream side in a moving direction of fixing belt 61 toward the fixing nip to promote separation of recording medium S from fixing belt 61.

Guide plate 70 is a member for guiding recording medium S having an unfixed toner image to the fixing nip. Guide rollers 71 are members for guiding the recording medium having the toner image fixed thereon from the fixing nip to the outside of image forming apparatus 10.

Returning to the description of FIG. 1. Recording medium conveyance section 80 has three sheet feed tray units 81 and a plurality of registration roller pairs 82. In sheet feed tray unit 81, recording medium (standard paper, special paper, etc. in the present embodiment) S identified based on basis weight, size, and the like is stored for each preset type. Registration roller pairs 82 are disposed so as to form a desired conveyance path.

In such image forming apparatus 10, based on the image data acquired by image reading section 20, the toner image is formed on recording medium S sent from recording medium conveyance section 80 by intermediate transfer section 40. Recording medium S on which the toner image is formed by intermediate transfer section 40 is sent to fixing device 60.

Fixing belt 61 in fixing device 60 is rotationally driven at a predetermined speed, and is heated to a desired temperature (for example, 190° C.) by heater 65 by feedback control by first temperature sensor 67, for example. Second pressure roller 64 is heated to a desired temperature (for example, 180° C.) by heater 66 by feedback control by second temperature sensor 68, for example. Then, in accordance with arrival of recording medium S, second pressure roller 64 urges an outer peripheral surface of first pressure roller 63 via fixing belt 61 to form a fixing nip.

On the other hand, recording medium S carrying the unfixed toner image is guided to the fixing nip while being guided by guide plate 70. As fixing belt 61 closely contacts recording medium S, the unfixed toner image is quickly fixed to recording medium S. Further, recording medium S receives airflow from airflow separation device 69 at a downstream end of the fixing nip. Therefore, separation of recording medium S from fixing belt 61 is promoted. The recording medium separated from fixing belt 61 is guided toward the outside of image forming apparatus 10 by guide rollers 71.

(Structure of Fixing Belt)

Next, fixing belt 61 will be described in detail. FIG. 3A is a perspective view of fixing belt 61, and FIG. 3B is an enlarged view of region A shown in FIG. 3A.

As shown in FIGS. 3A and 3B, fixing belt 61 has base layer 61*a*, elastic layer 61*b*, and surface layer 61*c*. Further, in fixing belt 61, base layer 61*a* is positioned inside and surface layer 61*c* is positioned outside.

Base layer 61*a* is made of a heat-resistant resin. The heat-resistant resin can be appropriately selected from resins which do not cause denaturation and deformation within a range of working temperature of fixing belt 61. Examples of the heat-resistant resin include polyphenylene sulfide, polyalylate, polysulfone, polyether sulfone, polyether imide, polyimide, polyamide imide, and polyether ether ketone. The heat-resistant resin is preferably polyimide from the viewpoint of heat resistance. One kind of heat-resistant resin may be used alone, or two or more kinds thereof may be used in combination.

Polyimide is obtained by heating a polyamic acid, which is a precursor thereof, at a temperature of 200° C. or more, or by using dehydration and cyclization (imidization) reaction of a polyamic acid with a catalyst. The polyamic acid may be produced by dissolving a tetracarboxylic acid dianhydride and a diamine compound in a solvent, and by polycondensation reaction by mixing and heating. Alternatively, a commercially available product may be used. Examples of the diamine compound and the tetracarboxylic acid dianhydride include compounds described in paragraphs 0123 to 0130 of Japanese Patent Application Laid-Open No. 2013-25120.

Base layer 61*a* may further contain components other than the heat-resistant resin within a range where an effect of the present embodiment can be obtained. For example, a material of base layer 61*a* may further contain another resin component. A content of the heat-resistant resin in the material of base layer 61*a* is preferably 40 to 100 volume % from the viewpoint of moldability and the like.

Elastic layer 61*b* is made of a heat-resistant elastic material. Examples of a material (elastic material) of elastic layer 61*b* include elastic resin materials such as silicone rubber, thermoplastic elastomer, and rubber material. The elastic material is preferably silicone rubber.

Examples of the silicone rubber include polyorganosiloxane or a heat-cured product thereof, and addition reaction type silicone rubber described in Japanese Patent Application Laid-Open No. 2009-122317. Examples of the polyorganosiloxane include dimethylpolysiloxane which is capped at both ends with a trimethylsiloxane group and has a vinyl group at a side chain as described in paragraph 0029 of Japanese Patent Application Laid-Open No. 2008-255283. One kind of silicone rubber may be used alone, or two or more kinds thereof may be used in combination.

A content of the elastic resin material in the elastic material is preferably 60 to 100 volume %, more preferably 75 to 100 volume %, still more preferably 80 to 100 volume %.

A thickness of elastic layer 61*b* is preferably 30 to 400 μm, more preferably 50 to 300 μm, still more preferably 100 to 250 μm, from the viewpoint of sufficiently exhibiting thermal conductivity and elasticity, for example.

Elastic layer 61*b* may further contain components other than the elastic resin material within a range where the effect of the present embodiment can be obtained. For example, the elastic material may further include a thermally conductive filler for enhancing thermal conductivity of the elastic layer. Examples of a material of the filler include silica, metallic silica, alumina, zinc, aluminum nitride, boron nitride, silicon nitride, silicon carbide, carbon, and graphite. A form of the filler is not limited and is, for example, a spherical powder, an amorphous powder, a flat powder, or a fiber.

Surface layer 61*c* has moderate releasability to the toner. Surface layer 61*c* is positioned on an outer surface of fixing belt 61 that abuts against recording medium S at the time of fixing. A material of surface layer 61*c* is a fluororesin containing carbon black. More specifically, examples of the material of surface layer 61*c* include fluororesins including a copolymer, such as polytetrafluoroethylene (PTFE), perfluoroalkoxy fluororesin (PFA), a copolymer of tetrafluoroethylene and ethylene (ETPE), and polyvinylidene fluoride (PVDF). The material of surface layer 61*c* is preferably perfluoroalkoxy fluororesin (PFA) from the viewpoints of production stability and heat resistance.

The carbon black controls a tensile modulus of elasticity of surface layer 61*c* to a predetermined value. Examples of a type of carbon black include Ketjen black, acetylene black, furnace black, and channel black. From the viewpoint of a primary average particle diameter being small, the carbon black is preferably acetylene black.

The carbon black is contained in surface layer 61*c* in an amount of 5 to 15 mass %. The carbon black contained in surface layer 61*c* is more preferably 6 to 13 mass %. When a content of the carbon black in surface layer 61*c* is less than 5 mass %, an effect of the carbon black cannot be obtained. On the other hand, when the content of the carbon black in surface layer 61*c* exceeds 15 mass %, the tensile modulus of elasticity cannot be controlled, and surface layer 61*c* easily breaks.

A primary average particle diameter of the carbon black is 10 to 50 μm. The primary average particle diameter of the carbon black is more preferably 20 to 30 μm. When the primary average particle diameter of the carbon black is less than 10 μm, a resistance value cannot be controlled. On the other hand, when the primary average particle diameter of the carbon black exceeds 50 μm, the tensile modulus of elasticity of surface layer 61*c* cannot be controlled to the predetermined value.

The primary average particle diameter of the carbon black can be measured with a transmission electron microscope (TEM: JEM-2000FX, JEOL, Ltd.).

On a surface of surface layer 61*c*, a plurality of protrusions is periodically disposed. Fixing belt 61 according to the present embodiment achieves high separability from recording medium S by the plurality of protrusions disposed on the surface of surface layer 61*c*. A shape of the protrusion can be appropriately designed as long as it can impart releasability to surface layer 61*c*. The shape of the protrusion may be a square pyramid, a triangular pyramid, or a cone. In the present embodiment, the shape of the protrusion is preferably the square pyramid from the viewpoint of productivity.

The plurality of protrusions satisfies $1.5 \leq b/a \leq 5.0$ where a distance (μm) between vertices of two adjacent protrusions is a and a height (μm) of the vertex is b. When height (μm) b of the vertex with respect to distance (μm) a between the vertices of the two adjacent protrusions is less than 1.5, recording medium S enters between the adjacent protrusions, and high separability cannot be obtained. On the other hand, when height (μm) b of the vertex with respect to distance (μm) a between the vertices of the two adjacent protrusions exceeds 5.0, it is difficult to maintain the shape of the protrusion, and high separability cannot be obtained.

Distance (μm) a between the vertices of the two adjacent protrusions and height (μm) b of the vertex need only satisfy the above relational expression at a rate of 50% per 1 $mm^2$ of surface layer 61*c*, and more preferably satisfy the above relational expression at a rate of 80% per 1 $mm^2$ of surface layer 61*c*. First, SEM image data of 10000 times SEM is prepared for distance (μm) a between vertices of two adjacent protrusions. Next, a plurality of protrusions included in 1 $mm^2$ of surface layer 61*c* is detected. Then, a distance between the vertices of the two adjacent protrusions is obtained. Further, for height (μm) b of the vertex, first SEM image data of 10000 times SEM is prepared. Next, a plurality of protrusions included in 1 $mm^2$ of surface layer 61*c* is detected. Next, with respect to each protrusion, the surface of the surface layer 61*c* and the vertex of the protrusion were sandwiched between two parallel lines, and a distance between the two parallel lines is obtained.

With respect to the surface of surface layer 61*c*, the plurality of protrusions is preferably formed in a region of 50% or more, more preferably in a region of 80% or more, and particularly preferably in a region of 100% (an entire surface of surface layer 61*c*).

The tensile modulus of elasticity of surface layer 61*c* is preferably 480 MPa or more and 700 MPa or less, more preferably 550 MPa or more and 640 MPa or less. When the tensile modulus of elasticity of surface layer 61*c* is less than 480 MPa, the shape may not be maintained. On the other hand, when the tensile modulus of elasticity of surface layer 61*c* is more than 700 MPa, surface layer 61*c* may be broken due to poor durability.

The tensile modulus of elasticity of surface layer 61*c* can be measured with a tensile tester (TENSILON RTF-1250: A & D Co., Ltd.). Further, as described above, the tensile modulus of elasticity of surface layer 61*c* can be adjusted by an amount of carbon black added.

A method for forming the plurality of protrusions can be appropriately selected from known techniques. For example, the plurality of protrusions can be formed by using a laser marker on the surface of formed surface layer 61*c*. The method for forming the plurality of protrusions by the laser marker is preferable from the viewpoint of productivity. Note that, even if surface layer 61*c* is processed by blasting or the like, since the protrusion becomes random, protrusions as in the present embodiment cannot be formed.

A thickness of surface layer 61*c* is preferably 5 to 40 μm, more preferably 10 to 35 μm, still more preferably 15 to 30 μm from the viewpoints of, for example, transfer of heat, following deformation of elastic layer 61*b*, and expression of releasability.

Surface layer 61*c* may further contain components other than the fluororesin insofar as the effect of the present embodiment can be obtained. For example, surface layer 61*c* may further contain lubricant particles. Examples of the lubricant particles include silicone resin particles and silica particles.

A content of the fluororesin in the material of surface layer 61*c* is preferably 70 to 100 volume % from the viewpoints of thermal conductivity and flexibility sufficiently following deformation of the elastic layer.

Fixing belt 61 may further include a layer other than above-described base layer 61*a*, elastic layer 61*b*, and surface layer 61*c*, as long as the effect of the present embodiment can be obtained. Examples of the other layer include a reinforcing layer.

The reinforcing layer is a layer for enhancing mechanical strength of fixing belt 61, and is disposed, for example, on a surface (an inner peripheral surface of base layer 61*a*) opposite to elastic layer 61*b* and surface layer 61*c* of fixing belt 61. The reinforcing layer can be made of the above-described heat-resistant resin, and its thickness can be appropriately determined.

Fixing belt 61 can be manufactured by using a known method for manufacturing a laminated fixing belt. For example, fixing belt 61 can be manufactured by a method including: a step of covering an outer surface of an endless molded body made of a heat-resistant resin to be base layer 61*a* with a tube to be surface layer 61*c*; a step of injecting an elastic material or a precursor thereof between the molded body and the tube; and a step of thermally curing the elastic material or the precursor as necessary.

As described above, since the fixing belt according to the present embodiment contains 5 to 15 mass % of the carbon black having the primary average particle diameter of 10 to 50 μm, surface layer 61*c* is in contact with recording medium S in an appropriate area. Therefore, the fixing belt has high releasability.

EXAMPLES

The present invention will be described more specifically with reference to the following examples and comparative examples. Hereinafter, unless otherwise specified, each operation was performed at room temperature (20° C.). Note that the present invention is not limited to the following examples and the like.

Example 1

Varnish containing polyamic acid and 8 mass % of carbon black based on an amount of polyamic acid was applied to an outside of a cylindrical mold while rotating it. Subsequently, the mold was dried at 300 to 450° C. and imidized to obtain a cylindrical polyimide tubular article (base layer) having an inner diameter of 99 mm, a length of 360 mm, and a thickness of 70 μm. As the polyamic acid, a polymer obtained by dehydration condensation of 3,3',4,4'-biphenyltetracarboxylic acid dianhydride and p-phenylenediamine was used.

A perfluoroalkoxy fluororesin powder pellet (950HPplus, Chemours-Mitsui Fluoroproducts Co., Ltd.) and 5 mass % of acetylene black (DENKA BLACK having a primary average particle diameter of 0.025 μm, Denka Co., Ltd.) were simultaneously fed into a twin screw extruder (Toyo Seiki Seisaku-sho, Ltd.) to obtain a fluorine tubular article (surface layer) having an inner diameter of 312 mm, a length of 400 mm, and a thickness of 30 μm.

A cylindrical core metal made of stainless steel having an outer diameter of 99 mm was closely adhered to an inside of the base layer, and a cylindrical mold for holding the surface layer on an inner peripheral surface was placed on an outside of the base layer. Next, while holding the core metal and the cylindrical mold coaxially, a cavity was formed between them. Subsequently, a silicone rubber material (X-34-2888: Shin-Etsu Chemical Co., Ltd.) was injected into the cavity and heated and cured to form an elastic layer of silicone rubber having a thickness of 200 μm.

Finally, the belt was fixed to a laser marker (MD-T1010W: Keyence Corporation), and a plurality of protrusions having a square pyramid shape was formed on an entire surface of the surface layer with a dot spacing of 5 μm, and laser power of 20% and 200 kHz. In this way, fixing belt 1 of Example 1 was obtained by superimposing the belt base material, the elastic layer of silicone rubber, and the surface layer made of fluororesin in this order.

A tensile modulus of elasticity was measured by preparing a test piece according to JIS K7161. Distance (μm) a between vertices of two adjacent protrusions and height (μm) b of the vertex were measured using a laser microscope (Vk-X250: Keyence Corporation).

Examples 2 to 5, Comparative Examples 1 to 3

Fixing belts 2 to 8 of Examples 2 to 4 and Comparative Examples 1 to 3 were respectively obtained in the same manner as in Example 1, except that a content of the acetylene black in Example 1 was changed to contents shown in the following Table 1.

Comparative Example 4

Fixing belt 9 of Comparative Example 4 was obtained in the same manner as in Example 1, except that DENKA BLACK, which is acetylene black, was changed to VULCAN P (Cabot Corporation, "VULCAN" is a registered trademark of the company), and a content of the acetylene black was changed to 4 mass % in Example 1.

Parameters of obtained fixing belts are shown in Table 1.

[Table 1]

TABLE 1

| Classification | Fixing belt No. | Surface layer: Tensile modulus of elasticity (MPa) | Surface layer: Surface roughness Ra | Surface layer: b/a | Carbon black: Content (mass %) | Carbon black: Primary average particle diameter (μm) |
|---|---|---|---|---|---|---|
| Example 1 | 1 | 480 | 1.19 | 1.5 | 5.0 | 25 |
| Example 2 | 2 | 550 | 1.22 | 1.5 | 6.0 | 25 |
| Example 3 | 3 | 600 | 1.22 | 1.5 | 11.0 | 25 |
| Example 4 | 4 | 640 | 1.21 | 1.5 | 13.0 | 25 |
| Example 5 | 5 | 700 | 1.19 | 1.5 | 15.0 | 25 |
| Comparative example 1 | 6 | 450 | 1.24 | 1.5 | 4.0 | 25 |
| Comparative example 2 | 7 | 830 | 1.22 | 1.5 | 16.0 | 25 |
| Comparative example 3 | 8 | 439 | 1.23 | 1.5 | 0.0 | 25 |
| Comparative example 4 | 9 | 470 | 2.49 | 1.5 | 4.0 | 300 |

[Evaluations]

Fixing belts 1 to 9 were installed as a fixing belt of an electrophotographic image forming apparatus equipped with a two-axis belt type fixing device as shown in FIG. 2. A roller constituting a fixing nip and provided on a side supporting the fixing belt (disposed to face a pressure roller) had a roller diameter of 60 mm. For each of the fixing belts, a surface temperature of the fixing belt was set to 180° C., a toner image (an amount of attached toner: 8 g/m$^2$) of a belt-like solid image of a magenta color having a width of 5 cm was transferred to an A4 size normal paper in a direction perpendicular to a conveying direction of the normal paper, and the normal paper was passed through the fixing nip in a longitudinal direction at a speed of 60 sheets/minute to form a fixed image of the above belt-like image on the normal paper.

(1) Evaluation of Separability

Separability of each of the fixing belts and the normal paper at the time of fixing the above belt-like solid image was evaluated according to the following criteria.

A: Paper is separated without curling.

B: Paper curls a little but no problem.

C: Cannot be separated (passing paper jam).

(2) Evaluation of Fixability

The above belt-like solid image was visually observed, and fixability was evaluated according to the following criteria. Image defects due to a fixing failure means image defects (roughness of appearance) due to a cold offset or image defects (occurrence of passing paper jam) due to a hot offset.

A: No defect due to fixing failure seen in solid image.

B: Fine defects seen but no problem.

C: Defects due to fixing failure seen in solid image.

Evaluation results of fixing belts 1 to 9 are shown in Table 2.

[Table 2]

TABLE 2

| Classification | Fixing belt No. | Fixability | Separability |
|---|---|---|---|
| Example 1 | 1 | B | B |
| Example 2 | 2 | A | A |
| Example 3 | 3 | A | B |
| Example 4 | 4 | A | B |
| Example 5 | 5 | B | B |

TABLE 2-continued

| Classification | Fixing belt No. | Fixability | Separability |
|---|---|---|---|
| Comparative example 1 | 6 | C | C |
| Comparative example 2 | 7 | C | C |
| Comparative example 3 | 8 | C | C |
| Comparative example 4 | 9 | C | C |

[Results]

As shown in Table 2, in fixing belts 1 to 5 in which the content of the carbon black having the primary average particle diameter of 10 to 50 μm is 5 to 15 mass % with respect to the fluororesin, the fixability and the separability were sufficient.

On the other hand, in Comparative Examples 1 to 3 in which the content of the carbon black is not 5 to 15 mass % and in Comparative Example 4 in which the particle diameter of the carbon black is not 10 to 50 μm, neither the fixability nor the separability was sufficient. This is thought to be because a predetermined amount of carbon black is not blended, though the plurality of protrusions is formed on the surface layer.

INDUSTRIAL APPLICABILITY

According to the present invention, in an electrophotographic image forming apparatus using a high-speed machine having a fixing belt, satisfactory fixing can be realized, and occurrence of paper jam can be prevented. Therefore, according to the present invention, further speeding up, high performance, and labor saving are expected in the electrophotographic image forming apparatus, and further spread of the image forming apparatus is expected.

Although embodiments of the present invention have been described and illustrated in detail, it is clearly understood that the same is by way of illustration and example only and not limitation, the scope of the present invention should be interpreted by terms of the appended claims

What is claimed is:

1. A fixing belt comprising:

a base layer made of a heat-resistant resin;

an intermediate layer made of a heat-resistant elastic material disposed on the base layer; and a surface layer made of a fluororesin disposed on the intermediate layer, the surface layer containing 5 to 15 mass % of carbon black having a primary average particle diameter of 10 to 50 μm.

2. The fixing belt according to claim 1, wherein the surface layer has a tensile modulus of elasticity of 480 MPa or more and 700 MPa or less.

3. The fixing belt according to claim 1, wherein the surface layer has surface roughness Ra of 0.2 to 7.0.

4. The fixing belt according to claim 1, wherein a plurality of protrusions is formed on the surface layer, and the plurality of protrusions satisfies $1.5 \leq b/a \leq 5.0$ where a distance between vertices of adjacent two of the protrusions is a μm and a height of the vertex is b μm.

5. The fixing belt according to claim 1, wherein the heat-resistant resin is polyimide, and the elastic material is silicone rubber.

6. A fixing device comprising:

an endless fixing belt;

two or more rollers that pivotally support the fixing belt;

a heater that heats the fixing belt; and a pressure roller disposed so as to be urged relatively with respect to one of the two or more rollers via the fixing belt, wherein an outer diameter of the one of the two or more rollers that is urged by the pressure roller is 50 mm or more, and the fixing belt is the fixing belt according to claim 1.

7. The fixing device according to claim 6, wherein the fixing belt is pivotally supported by the two or more rollers so that tension is 45 N or less.

8. An image forming apparatus comprising a fixing device that fixes an unfixed toner image electrophotographically formed on a recording medium onto the recording medium by heating and pressing, wherein the fixing device is the fixing device according to claim 6.

* * * * *